United States Patent [19]

Iwata

[11] 4,244,276

[45] Jan. 13, 1981

[54] HYDRAULIC CIRCUIT

[75] Inventor: Michiyoshi Iwata, Gifu, Japan

[73] Assignee: Teijin Seiki Company Limited, Osaka, Japan

[21] Appl. No.: 58,109

[22] Filed: Jul. 16, 1979

[51] Int. Cl.[3] ..... F15B 13/04

[52] U.S. Cl. ..... 91/447; 91/45

[58] Field of Search ..... 91/44, 45, 447, 448, 91/451, 452

[56] References Cited

U.S. PATENT DOCUMENTS

| | | | |
|---|---|---|---|
| 3,668,973 | 6/1972 | Kado et al. | 91/45 X |
| 3,895,779 | 7/1975 | Cassez et al. | 91/44 X |
| 3,976,097 | 8/1976 | Brakel | 91/448 X |
| 3,980,001 | 9/1976 | Cyphelly | 91/448 X |
| 3,990,583 | 11/1976 | Nishida et al. | 91/448 X |
| 4,012,031 | 3/1977 | Mitchell et al. | 91/447 X |

*Primary Examiner*—Robert L. Bleutge

*Attorney, Agent, or Firm*—Cushman, Darby & Cushman

[57] ABSTRACT

An improved hydraulic control circuit is disclosed for use in crawler type vehicles and the like in which relief valves as used in conventional circuits are eliminated. The resulting hydraulic circuit is not apt to be damaged by surge pressures and high pressures in the return passages, are simple in their design and more convenient to fabricate.

3 Claims, 2 Drawing Figures

HYDRAULIC CIRCUIT

BACKGROUND OF THE INVENTION

This invention relates to a hydraulic circuit which is applied for crawler type vehicles such as bulldozers, power shovels and the like.

Conventionally, there has been known a hydraulic circuit which comprises a hydraulic source; a reservoir tank connected with the hydraulic source through a first hydraulic passage; a change-over valve connected with the hydraulic source and the reservoir tank through second and third hydraulic passages, respectively; a spool valve connected with the change-over valve through a pair of hydraulic pipes; a hydraulic actuator having a pair of inlet-outlet ports; and a pair of inlet-outlet passages each having one end connected with the spool valve and the other end connected with the inlet-outlet port of said hydraulic actuator; a first relief passage having one end connected with one of the inlet-outlet passages and the other end connected with the other of the inlet-outlet passages and provided with a first relief valve relieving a hydraulic fluid in one of the inlet-outlet passages to the other of the inlet-outlet passages when the hydraulic fluid in one of the inlet-outlet passages is raised to a predetermined relief pressure; a second relief passage having one end connected with the other of the inlet-outlet passages and the other end connected with the one of the inlet-outlet passages and provided with a second relief valve relieving a hydraulic fluid in the other of the inlet-outlet passages to the one of the inlet-outlet passages when the hydraulic fluid in the other of the inlet-outlet passages raised to a predetermined relief pressure; the spool valve including a pair of connecting passages each connecting the hydraulic pipe and the inlet-outlet passage and having a main check valve to allow a hydraulic fluid to flow from the hydraulic pipe to the inlet-outlet passage; a pair of spool passages each having one end connected with the connecting passage between the main check valve and the hydraulic pipe and the other end connected with the connecting passage between the main check valve and the inlet-outlet passage; a valve spool axially movable to open and close the spool passages; a pair of compression coil springs urging the valve spool to be brought into a null position; a pair of pilot passages each having one end connected with the connecting passage between the main check valve and the hydraulic pipe to bring the connecting passage into communication with the valve spool so as to axially move the valve spool against the compression coil spring; and a check valve provided on each of the pilot passage to allow the hydraulic fluid from the connecting passage to the valve spool. The conventional hydraulic circuit, however, requires two relief valves and therefore becomes not only complicated and extremely expensive but also bulky in size. Although it may be considered to omit two relief valves and two relief passages as provided in the conventional hydraulic circuit for the purpose of overcoming the aforementioned drawbacks, there is a possibility to damage the hydraulic circuit when a surge pressure occurs in the inlet-outlet passage. In order to avoid the problems it may be also considered to provide a throttle in the pilot passage in parallel with the check valve to slowly axially move the valve spool for opening and closing action of the valve spool. In this case, however, the change-over valve is actuated to instantly close the hydraulic fluid returned from the hydraulic actuator. So that a high pressure is generated in the circuit between the actuator and the valve spool.

OBJECTS OF THE INVENTION

It is therefore an object of the present invention to provide a hydraulic circuit which can eliminate relief valves as employed in the conventional hydraulic circuit and which is simple and not bulky in construction and not expensive.

It is another object of the present invention to provide a hydraulic circuit which is not damaged by the surge pressure and high pressure in their return passages.

SUMMARY OF THE INVENTION

In order to attain the above objects, the hydraulic circuit of the present invention comprises: a hydraulic source; a reservoir tank connected with the hydraulic source through a first hydraulic passage; a change-over valve connected with the hydraulic source and the reservoir tank through second and third hydraulic passages, respectively; a spool valve connected with the change-over valve through a pair of hydraulic pipes; a hydraulic actuator having a pair of inlet-outlet ports; and a pair of inlet-outlet passages each having one end connected with the spool valve and the other end connected with the inlet-outlet port of the hydraulic actuator; the spool valve including a pair of connecting passages each connecting the hydraulic pipe and the inlet-outlet passage and having a main check valve to allow a hydraulic fluid to flow from the hydraulic pipe to the inlet-outlet passage; a pair of spool passages each having one end connected with the connecting passage between the main check valve and the hydraulic pipe and the other end connected with the connecting passage between the main check valve and the inlet-outlet passage; a valve spool axially movable to open and close the spool passages; a pair of compression coil springs urging the valve spool to be brought into a null position; a pair of pilot passages each having one end connected with the connecting passage between the main check valve and the hydraulic pipe to bring the connecting passage into communication with the valve spool so as to axially move the valve spool against the compression coil spring; a pair of throttle bores each provided on each of the pilot passages; two pairs of additional pilot passages each having one end connected with the pilot passage between the throttle bore and the connecting passage between the main check valve and the hydraulic pipe and the other end connected with the pilot passage between the throttle bore and the valve spool; and two pairs of auxiliary check valves each provided on each of the additional pilot passages, the pair of adjacent auxiliary check valves being adapted to allow the hydraulic fluid to pass through the pair of the adjacent additional pilot passages in opposite directions. The other aspect of the hydraulic circuit according to the present invention, comprises: a hydraulic source; a reservoir tank connected with the hydraulic source through a first hydraulic passage; a change-over valve connected with the hydraulic source and the reservoir tank through second and third hydraulic passages, respectively; a spool valve connected with the change-over valve through a pair of hydraulic pipes; a hydraulic actuator having a pair of inlet-outlet ports; and a pair of inlet-outlet passages each having one end connected with the spool valve and the other end connected with the inlet-outlet port of the hydraulic actuator; the spool valve including a pair of connecting passages each connecting the hydraulic pipe and the inlet-outlet passage and having a main check valve to allow a hydraulic fluid to flow from the hydraulic pipe to the inlet-outlet passage; a pair of spool passages each having one end connected with the connecting passage between the main check valve and the hydraulic pipe and the other end connected with the connecting passage between the main check valve and the inlet-outlet passage; a valve spool axially movable to open and close the spool passages; a pair of compression coil springs urging the valve spool to be brought into a null position; a pair of pilot passages each having one end connected with the connecting passage between the main check valve and the hydraulic pipe to bring the connecting passage into communication with the valve spool so as to axially move the valve spool against the compression coil spring; a pair of throttle bores each provided on each of the pilot passages; a pair of relief passages having one end connected with the connecting passage between the main check valve and the inlet-outlet passage and the other end connected with the connecting passage between the main check valve and the hydraulic pipe; and a pair of relief valves each provided on each of the relief passages to allow the hydraulic fluid to be discharged from the connecting passage between the main check valve and the inlet-outlet passage to the connecting passage between the main check valve and the hydraulic pipe.

The above and other objects, features and advantages of the present invention will become clear from the following particular description of the invention and the appended claims, taken in conjunction with the accompanying drawings which show by way of example a preferred embodiment of the present invention.

DETAILED DESCRIPTION OF THE PREFERRED EMBODIMENT

Figure 1:
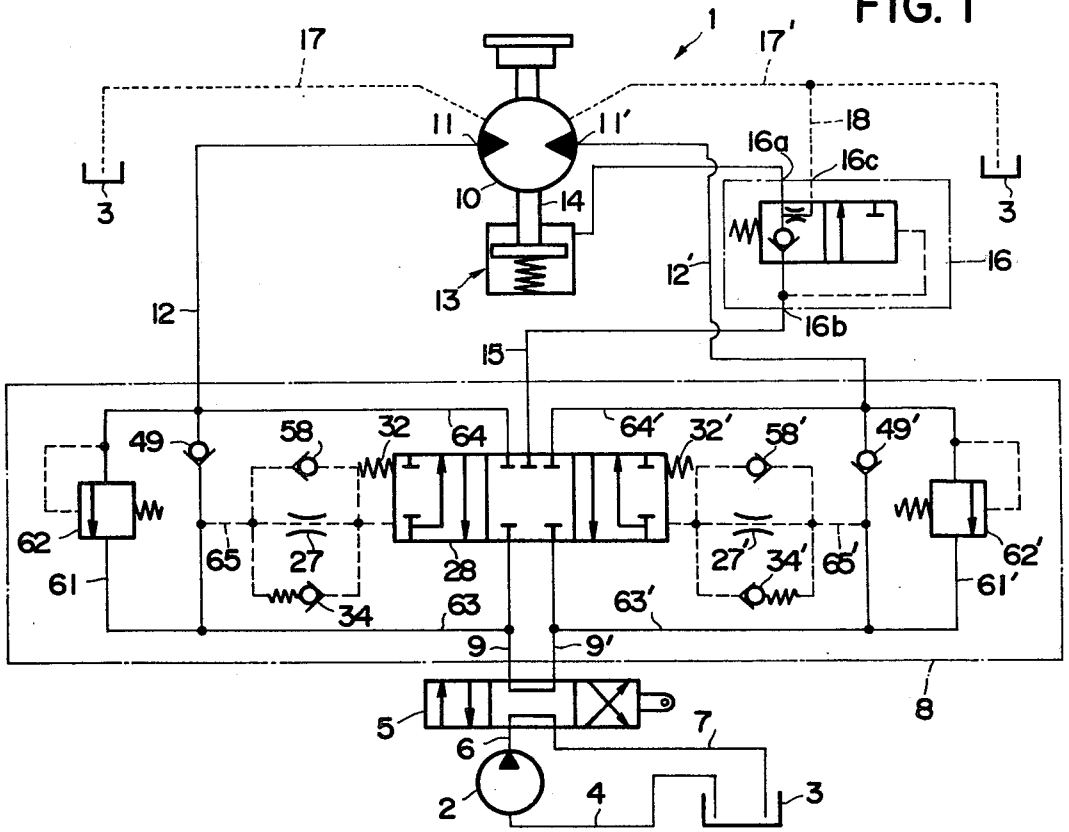
FIG. 1 is a hydraulic circuit showing one embodiment of the present invention.

Referring now to the drawings and in particular to FIG. 1, there is shown a hydraulic circuit of the present invention, generally indicated at 1, used for crawler type vehicles such as for example bulldozers, power shovels and the like. The hydraulic circuit comprises a hydraulic source 2 such as a pump for discharging a hydraulic fluid which is designed to be connected with a reservoir tank 3 through a first hydraulic passage 4. A change-over valve 5 is connected with the hydraulic source 2 through a second hydraulic passage 6 and with the reservoir tank 3 through a third hydraulic passage 7. A spool valve 8 is connected with the change-over valve 5 through a pair of hydraulic pipes 9 and 9'. A hydraulic actuator 10 such as a hydraulic motor has a pair of inlet-outlet ports 11 and 11' which are connected with the spool valve 8 through a pair of inlet-outlet passages 12 and 12', respectively. Generally indicated by the reference numeral 13 is a brake mechanism which is coupled with an output shaft 14 of the hydraulic actuator 10 and is connected through a first passage 15 with a hydraulic passage of the spool valve 8 which will hereinlater be described. The brake mechanism 13 is designed to brake the hydraulic actuator 10 when the hydraulic fluid does not enter the brake mechanism 13 and to release the hydraulic actuator 10 from the braked condition thereof when the hydraulic fluid enter the brake mechanism 13. A pilot operated three ports-two positions change-over valve 16 is provided on the first passage 15 and has a first port **16*a*, a second port 16*b* and a third port 16*c*. The first port 16*a* and the second port 16*b* are each connected with the first passage 15. A pair of drain passages 17 and 17' are each connected at one end with the hydraulic actuator 10 and at the other end with the reservoir tank 3, so that a drain fluid leaked out of the hydraulic actuator 10 is returned to the reservoir tank 3. The third port 16*c* of the pilot operated three ports-two positions change-over valve 16 is connected with the drain passage 17' through a drain pipe 18**.

Figure 2:
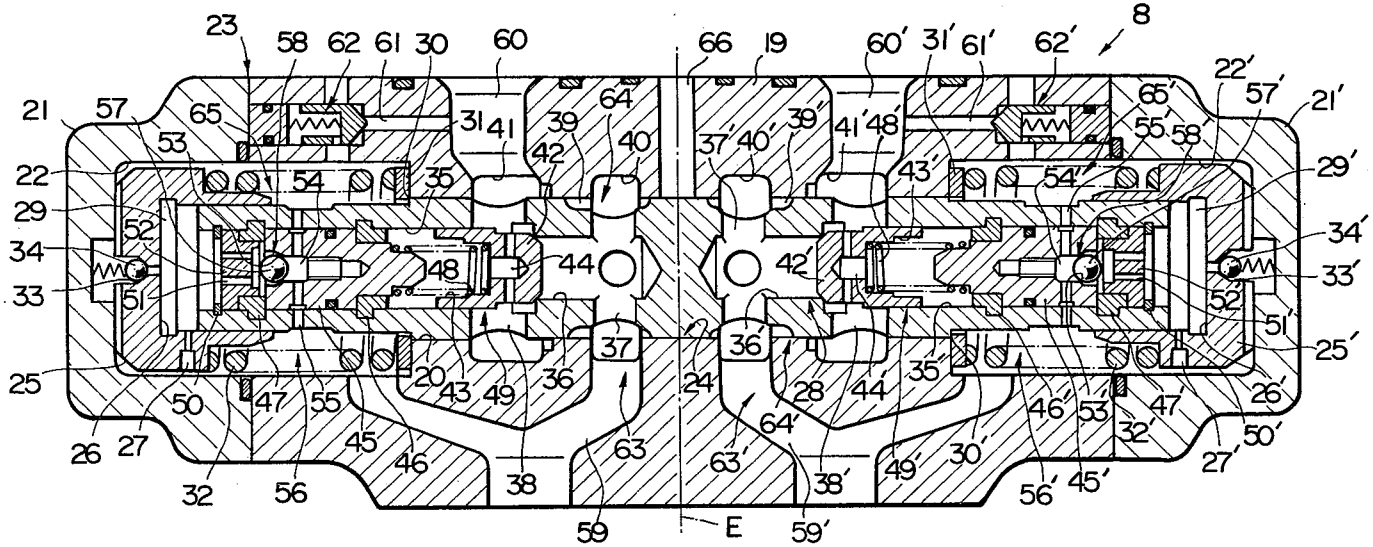
FIG. 2 is a cross-sectional view of a valve spool employed in the hydraulic circuit of the present invention.

As best shown in FIGS. 1 and 2, the spool valve 8 has a housing case 19 in which an axial bore 20 is formed to axially extend therein, and closed by a pair of covers 21 and 21' having recesses 22 and 22', respectively, formed on the inner faces thereof. The combination of the housing case 19 and the covers 21 and 21' constitutes as a whole a casing generally indicated by the reference numeral 23. A receiving chamber 24 is defined by the axial bore 20 and the recesses 22 and 22' to axially slidably receive therein a valve spool which will become apparent as the description proceeds. In this instance, the spool valve 8 comprises an internal construction which is entirely symmetrical with respect to an equatorial place passing through a center line E perpendicular to an axis of the spool valve 8 so that there will be a particular description on one half of the spool valve 8 hereinafter while a particular description on the other half of the spool valve 8 being omitted to avoid repeated and tedious explanation. The constitutional elements or parts of the other half of the spool valve 8 same as those of one half of the spool valve 8 are primed with the reference numerals same as those of one half of the spool valve 8. Loosely fitted with the recess 22 is a chamber block 25 in which a recess 26 is formed. A throttle bore 27 is formed in the chamber block 25 to have one end opened at the inner surface of the chamber block 25 in the vicinity of the bottom face of the recess 26 and the other end opened at the outer surface of the chamber block 25. Slidably received in the receiving chamber 24 is a valve spool generally indicated at 28 which has both axially outer end portions inserted into the recesses 26 and 26' of the chamber block 25 and 25'. A cushion chamber 29 is defined by the recess 26 and the axially outer end face of the valve spool 28 so that when the valve spool 28 is moved axially outwardly the cushion chamber 29 acts to prevent abrupt axial movement of the valve spool 28 by the reason that the hydraulic fluid within the cushion chamber 29 is discharged through the throttle bore 27. The valve spool 28 has at its outer peripheral an annular step 30 which is in abutting engagement with an annular ring 31. Between the annular ring 31 and the chamber block 25 is interposed a compression coil spring 32 which serves to urge the valve spool 28 toward its null position. A passage 33 is formed axially extending in the chamber block 25 and receives a first auxiliary check valve 34 which allows only the hydraulic fluid within the cushion chamber 29 to be discharged into the recess 22. The first auxiliary check valve 34 causes the hydraulic fluid within the cushion chamber 29 to be discharged therefrom and permits the valve spool 28 to abruptly be moved in the case that the hydraulic pressure in the cushion chamber 29 becomes larger than the hydraulic pressure in the cushion chamber 29 when the valve spool 28 is resilient urged only by the compression coil spring 32'. In the valve spool 28 is formed an internal bore 35 extending axially inwardly from the axially outer end to be connected with an additional internal bore 36 smaller in diameter than the internal bore 35. A plurality of radial bores 37 are formed in the valve spool 28 to be connected at their radially inner ends with the additional internal bore 36 and are opened at their radially outer end on the outer surface of the valve spool 28. Formed in the valve spool 28 to extend radially are a plurality of communication bores 38 each of which has a radially inner end opened at the internal bore 35 and a radially outer end opened at the outer surface of the valve spool 28. An annular cut-off portion 39 is formed at the outer periphery of the valve spool 28 in communication with the radial bore 37 to extend axially toward the communication bore 38. An annular groove 40 is formed on the inner wall of the axial bore 20 in opposing relation with the radially inner end of the radial bore 37 and also another annular groove 41 is formed on the inner wall of the axial bore 20 in opposing relation with the radially inner end of the communication bore 38. Slidably received in the axially inner end portion of the internal bore 35 is a valve body 42 which has a spring chamber 43 formed therein and a passage 44 connected at one end with the bottom portion of the spring chamber 43 and at the other end with the communication bore 38. A plug member 45 is accommodated in the internal bore 35 axially outwardly of the valve body 42 so as to be prevented from being axially moved by means of a pair of stop members 46 and 47 secured to the internal bore 35. A compression coil spring 48 is positioned in the valve spool 28 to have one end in engagement with the bottom of the spring chamber 43 and the other end in engagement with the plug member 45 so that the valve body 42 is at all times urged axially inwardly by the compression coil spring 48 until the axially inner end of the valve body 42 is brought into abutting engagement with an annular step defined by the internal bore 35 and the additional internal bore 36 not so as to communicate the additional internal bore 36 and the communication bore 38. The previously mentioned valve body 42 and the compression coil spring 48 constitute as a whole a main check valve generally indicated at 49 which allows only the hydraulic fluid to flow from the internal bore 36 to the communication bore 38. A snap ring 50 is secured to the internal bore 35 axially outwardly of the plug member 45, and a stop member 52 with a plurality of through bores 51 is provided between the snap ring 50 and the plug member 45. On the axially outer face of the plug member 45 is formed a conical plug bore 53 which is in communication with one end of a passage 54 having the other end opened at the outer periphery of the plug member 45. Formed in the valve spool 28 is a plurality of radial bores 55 each of which has a radially inner end in communication with the passage 54 and a radially outer end in communication with a spring chamber generally indicated at 56 and defined by the casing 23, the chamber block 25 and the valve spool 28. A ball 57 is provided between the stop member 52 and the plug member 45 so that the engagement of the ball 57 with the conical plug bore 53 causes the through bores 51 not to be brought into communication with the passage 54 while the disengagement of the ball 57 with the conical plug bore 53 causes the through bores 51 to be brought into communication with the passage 54. The combination of the previously mentioned stop member 52, the conical plug bore 53 and the ball 57 constitutes as a whole a second auxiliary check valve, generally denoted by the reference numeral 58 which permits the hydraulic fluid to be discharged to the cushion chamber 29 from the spring chamber 56. Formed in the housing case 19 is a passage 59 having one end portion which is adapted to be bifurcated to have one branch in communication with the spring chamber 56 and remaining branch in communication with the annular groove 40, and the other end portion in communication with the hydraulic passage 9. A passage 60 is formed in the housing case 19 to have one end in communication with the another annular groove 41 and the other end in communication with the inlet-outlet passage 12. A relief passage 61 is formed in the housing case 19 to have one end in communication with the passage 60 and the other end in communication with the spring chamber 56. On the relief passage 61 is provided a relief valve 62 which allows the hydraulic fluid to flow to the spring chamber 56 from the passage 60. The relief valve 62 serves only to remove the surge pressure caused by load of the crawler type vehicle when the vehicle is stopped by the action of the change-over valve 5 during its running on the down slope. As the relief valve 62, a direct operated relief valve may be employed according to the present invention. The set pressure of the relief valve 62 allows to extent in a wide range in comparison with the conventional relief valve. The combination of the previously mentioned passage 59, the annular groove 40, the radial bores 37, the additional internal bore 36, the communication bores 38, the another annular groove 41 and the passage 60 constitutes as a whole a connecting passage, generally indicated at 63, which connects the hydraulic pipe 9 and the inlet-outlet passage 12. On the connecting passage 63 is provided a main check valve 49 which allows the hydraulic fluid to flow from the hydraulic pipe 9 to the inlet-outlet passage 12 as previously described. A spool passage 64 comprises a cut-off portion and is adapted to connect the connecting passage 63 between the main check valve 49 and the hydraulic pipe 9 with the connecting passage 63 between the main check valve 49 and the inlet-outlet passage 12 so that the spool passage 64 can be opened and closed by the axial movement of the valve spool 28. The combination of the previously mentioned spring chamber 56, the cushion chamber 29, the passages 33, 54 and the radial bores 55 constitutes as a whole a pilot passage 65 which is connected at one end with the connecting passage 63 between the main check valve 49 and the hydraulic pipe 9 so that the hydraulic fluid in the connecting passage 63 is fed to the valve spool 28 to move the valve spool 28 axially. The cushion chamber 29 is corresponding to the pilot passage 65 between the throttle bore 27 and the valve spool 28 whereas the spring chamber 56, the passages 33, 54 and the axial bore 55 is corresponding to the pilot passage 65 between the connecting passage 63 and the throttle bore 27. It is therefore to be noted that the throttle bore 27, the first auxiliary check valve 34 and the second auxiliary check valve 58 are disposed in parallel relation with each other on the pilot passage 65. It will also be understood that the relief passage 61 is connected at one end with the connecting passage 63 between the main check valve 49 and the inlet-outlet passage 12 and at the other end with the connecting passage 63 between the main check valve 49 and the hydraulic pipe 9 through the pilot passage 65. The relief valve 62 on the relief passage 61 is thus to be noted to allow the hydraulic fluid to flow from the connecting passage 63 between the main check valve 49 and the inlet-outlet passage 12 to the connecting passage 63 between the main check valve 49 and the hydraulic pipe 9. Formed at the central portion of the housing case 19 is a radially extending hydraulic passage 66 which has a radially inner end opened at the axial bore 20 and a radially outer end in communication with the first passage 15, with the result that when the valve spool 28 is moved axially to its extremest end the hydraulic passage 66 is brought into communication with the hydraulic pipe 9 to allow the hydraulic fluid at a high pressure to flow into the valve spool 28.

The operation of the hydraulic circuit thus constructed above will be described hereinlater.

The hydraulic source 2 is driven to discharge a hydraulic fluid. At this time, the change-over valve 5 is changed so as to enable the second hydraulic passage 6 in communication with the hydraulic pipe 9 and to enable the third hydraulic passage 7 in communication with the hydraulic pipe 9'. The hydraulic fluid discharged from the hydraulic source 2 flows into the additional internal bore 36 through the second hydraulic passage 6, the hydraulic pipe 9, the passage 59, and the annular groove 40 to move the valve body 42 axially outwardly and then flows into the hydraulic actuator 10 through the communication bore 38, the another annular groove 41, the passage 60, and the inlet-outlet passage 12 to drive the hydraulic actuator 10. On the other hand, a part of the hydraulic fluid in the passage 59 flows into the passage 54 through the spring chamber 56 and the radial bore 55 to move the ball 57 radially outwardly and then flows into the cushion chamber 29 through the through bores. The hydraulic fluid in the cushion chamber 29 urges the valve spool 28 to move toward the cover 21' so that the pressure of the hydraulic pressure remaining in the cushion chamber 29' is raised to open the first auxiliary check valve 34', thereby causing the hydraulic fluid in the cushion chamber 29' to flow into the spring chamber 56' which houses therein a relatively low pressure fluid. As a result, the valve spool 28 is rapidly moved toward the cover 21' so that the annular groove 40 is brought into communication with the another annular groove 41' through the annular cut-off portion 39. The movement of the valve spool 28 causes the hydraulic passage 66 to be brought into communication with the annular groove 40 so that the hydraulic fluid in the annular groove 40 flows into the brake mechanism 13 through the hydraulic passage 66 and the first passage 15 to brake the brake mechanism 13. At this time, the pilot operated three ports-two positions change-over valve 16 is changed urging the spring by a pilot pressure of the fluid fed through the first passage 15 so that the first port **16*a* is brought into communication with the second port 16*b* and the third port 16*c* becomes closed. The pressure dropped hydraulic fluid after driving the hydraulic actuator 10 is returned to the reservoir tank 3 through the inlet-outlet passage 12, the passage 60, the another annular groove 41', the annular cut-off portion 39', the annular groove 40', the passage 50', the hydraulic pipe 9, and the third hydraulic passage 7. At this time, valve spool 28 is rapidly moved as previously mentioned so that the pressure in the inlet-outlet passage 12' is not so raised as to make the hydraulic actuator 10 to smoothly start. When hydraulic actuator 10 becomes in the state that it acts as a pump although the hydraulic fluid is fed to the hydraulic actuator 10, such as when the crawler type vehicle runs on the down slope, the pressure of the hydraulic fluid discharged from the hydraulic source 2 is decreased. The pressure of the hydraulic fluid in the spring chamber 56 and the pressure of the hydraulic fluid in the cushion chamber 29 are simultaneously decreased, and the valve spool 28 is thus urged by the compression coil spring 32' to be moved toward the cover 21, i.e., its null position. Although there is caused at this time a pressure corresponding to an urging pressure of the compression coil spring 32' in the cushion chamber 29, the first check valve 34 is adapted not to be operated by that pressure so that the pressure of the hydraulic fluid remaining in the cushion chamber 29 flows little by little into the spring chamber 56 through the throttle bore 27, resulting in decreasing the movement speed of the valve spool 28. The movement of the valve spool 28 in turn causes the annular groove 40' to be gradually brought into communication with the another annular groove 41' in a throttled manner by means of the annular cut-off portion 39'. It is thus to be noted that the decreased speed movement of the valve spool 28 and the throttling effect of the cut-off portion 39' causes the annular grooves 40' and the another annular groove 41' to be gradually brought into communication with each other so that the pressure of the hydraulic pressure in the inlet-outlet passage 12' is raised up to an appropriate pressure without causing a surge pressure therein and a back pressure is hence acted upon and the brake the hydraulic actuator 10. Under these conditions, the change-over valve 5 is changed to its null position to stop the crawler type vehicle. At this time, the valve spool 28 is moved around its null position so that the valve spool 28 is moved to its null position simultaneously with the movement of the change-over valve 5 to its null position, thereby preventing the annular groove 40' from being in communication with the annular groove 41'. However, the pressure of the hydraulic fluid in the inlet-outlet passage 12 is at this time raised as the hydraulic actuator 10 acts as a pump. When the pressure of the hydraulic fluid in the inlet-outlet passage 12' is raised to its predetermined level, the relief valve 62' is opened to permit the hydraulic fluid at the predetermined pressure to be relieved from the inlet-outlet passage 12' to the hydraulic pipe 9', thereby preventing the surge pressure from being caused in the inlet-outlet passage 12'. The relief valve 62' can be acted by a relief set pressure which is at least one half of that of the conventional relief valves. In this embodiment, the relief valve 62' is provided in parallel relation with the check valve 49' so that the set pressure of the relief valve 62' may be raised only up to the pressure of the return passage of the hydraulic fluid returning from the hydraulic actuator 10. On the contrary to the above embodiment, the conventional relief valves are provided between the supply and return passages of the hydraulic actuator so that the set pressure of each of the relief valves is required to be raised up to a pressure level higher than the hydraulic pressure of the supply passage. The relief valves 62 and 62' may be provided in the hydraulic circuit, which do not have the first auxiliary check valves 34, 34' and the second auxiliary check valves 58, 58'**, in order to obtain the same advantage as above.

The change-over valve 5 has been shown and described as above a center by-pass type in which the second and third hydraulic passages 6 and 7 are brought into communication with each other and the hydraulic pipes 9 and 9' are also brought into communication with each other under the state of a null position. However, the change-over valve 5 may be replaced by a suitable open center type which is so constructed to have all the ports which are brought into communication with each other under the state of a null position.

According to the present invention, the conventional relief valves provided between the supply and return passages of the hydraulic circuit can be eliminated, which makes it possible not only to simplify the hydraulic circuit but also produce inexpensive and small sized hydraulic circuit. In addition, the hydraulic circuit will not be damaged by the surge pressure, and a high pressure is not generated in the return passage of the hydraulic pressure.

Although particular embodiment of the present invention have been shown and described, it will be obvious to those skilled in the art that various changes and modifications may be made without departing from the spirit and scope of the present invention.

What is claimed is:

1. A hydraulic circuit, comprising in combination: a hydraulic source; a reservoir tank connected with said hydraulic source through a first hydraulic passage; a change-over valve connected with said hydraulic source and said reservoir tank through second and third hydraulic passages, respectively; a spool valve connected with said change-over valve through a pair of hydraulic pipes; a hydraulic actuator having a pair of inlet-outlet ports; and a pair of inlet-outlet passages each having one end connected with said spool valve and the other end connected with said inlet-outlet port of said hydraulic actuator; said spool valve including a pair of connecting passages each connecting said hydraulic pipe and said inlet-outlet passage and having a main check valve to allow a hydraulic fluid to flow from said hydraulic pipe to said inlet-outlet passage; a pair of spool passages each having one end connected with said connecting passage between said main check valve and said hydraulic pipe and the other end connected with said connecting passage between said main check valve and said inlet-outlet passage; a valve spool axially movable to open and close said spool passages; a pair of compression coil springs urging said valve spool to be brought into a null position; a pair of pilot passages each having one end connected with said connecting passage between said main check valve and said hydraulic pipe to bring said connecting passage into communication with said valve spool so as to axially move said valve spool against said compression coil spring; a pair of throttles each provided on each of said pilot passages; two pairs of additional pilot passages each having one end connected with said pilot passage between said throttle and said connecting passage between said main check valve and said hydraulic pipe and the other end connected with said pilot passage between said throttle and said valve spool; and two pairs of auxiliary check valves each provided on each of said pilot passages, said pair of adjacent auxiliary valves being adapted to allow said hydraulic fluid to pass through said pair of said adjacent pilot passages in opposite directions.

2. A hydraulic circuit, comprising in combination: a hydraulic source; a reservoir tank connected with said hydraulic source through a first hydraulic passage; a change-over valve connected with said hydraulic source and said reservoir tank through second and third hydraulic passages, respectively; a spool valve connected with said change-over valve through a pair of hydraulic pipes; a hydraulic actuator having a pair of inlet-outlet ports; and a pair of inlet-outlet passages each having one end connected with said spool valve and the other end connected with separate ones of said inlet-outlet ports of said hydraulic actuator; said spool valve including a pair of connecting passages each connecting said hydraulic pipe and said inlet-outlet passage and having a main check valve to allow a hydraulic fluid to flow from said hydraulic pipe to said inlet-outlet passage; a pair of spool passages each having one end connected with said connecting passage between said main check valve and said hydraulic pipe and the other end connected with said connecting passage between said main check valve and said inlet-outlet passage; a valve spool axially movable to open and close said spool passages; a pair of compression coil springs urging said valve spool to be brought into a null position; a pair of pilot passages each having one end connected with said connecting passage between said main check valve and said hydraulic pipe to bring said connecting passage into communication with said valve spool so as to axially move said valve spool against said compression coil spring; a pair of throttles each provided on each of said pilot passages; a pair of relief passages having one end connected with said connecting passage between said main check valve and said inlet-outlet passage and the other end connected with said connecting passage between said main check valve and said hydraulic pipe; and a pair of relief valves each provided on each of said relief passages to allow said hydraulic fluid to be discharged from said connecting passage between said main check valve and said inlet-outlet passage to said connecting passage between said main check valve and said hydraulic pipe.

3. A hydraulic circuit, comprising in combination: a hydraulic source; a reservoir tank connected with said hydraulic source through a first hydraulic passage; a change-over valve connected with said hydraulic source and said reservoir tank through second and third hydraulic passages, respectively; a spool valve connected with said change-over valve through a pair of hydraulic pipes; a hydraulic actuator having a pair of inlet-outlet ports; and a pair of inlet-outlet passages each having one end connected with said spool valve and the other end connected with said inlet-outlet port of said hydraulic actuator; said spool valve including a pair of connecting passages each connecting said hydraulic pipe and said inlet-outlet passage and having a main check valve to allow a hydraulic fluid to flow from said hydraulic pipe to said inlet-outlet passage; a pair of spool passages each having one end connected with said connecting passage between said main check valve and said hydraulic pipe and the other end connected with said connecting passage between said main check valve and said inlet-outlet passage; a valve spool axially movable to open and close said spool passages; a pair of compression coil springs urging said valve spool to be brought into a null position; a pair of pilot passages each having one end connected with said connecting passage between said main check valve and said hydraulic pipe to bring said connecting passage into communication with said valve spool so as to axially move said valve spool against said compression coil spring; a pair of throttles each provided on each of said pilot passages;

two pairs of additional pilot passages each having one end connected with said pilot passage between said throttle and said connecting passage between said main check valve and said hydraulic pipe and the other end connected with said pilot passage between said throttle and said valve spool; and two pairs of auxiliary check valves each provided on each of said pilot passages, said pair of adjacent auxiliary check valves being adapted to allow said hydraulic fluid to pass through said pair of said adjacent pilot passages in opposite directions; a pair of relief passages having one end connected with said connecting passage between said main check valve and said inlet-outlet passage and the other end connected with said connecting passage between said main check valve and said hydraulic pipe; and a pair of relief valves each provided on each of said relief passages to allow said hydraulic fluid to be discharged from said connecting passage between said main check valve and said inlet-outlet passage to said connecting passage between said main check valve and said hydraulic pipe.

* * * * *